US006571974B1

(12) United States Patent
Ferri

(10) Patent No.: US 6,571,974 B1
(45) Date of Patent: Jun. 3, 2003

(54) CONTAINER CLOSURE

(76) Inventor: Louis Ferri, 1642 NE. 17th Ave., Ocala, FL (US) 34470

( * ) Notice: Subject to any disclaimer, the term of this patent is extended or adjusted under 35 U.S.C. 154(b) by 0 days.

(21) Appl. No.: 10/056,306

(22) Filed: Jan. 23, 2002

(51) Int. Cl.[7] ..... B65D 17/44; B65D 51/24; B65D 41/00; B67D 5/00

(52) U.S. Cl. ..... 220/278; 222/83; 215/303; 215/305

(58) Field of Search ..... 215/301, 303, 215/305; 220/278; 222/81, 551, 83; D9/437; 16/441; 411/405, 408, 473, 480; D8/80, 83, 107, 303; D4/129

(56) References Cited

U.S. PATENT DOCUMENTS

| | | | | | |
|---|---|---|---|---|---|
| D37,923 | S | * | 3/1906 | Tower | D8/83 |
| 2,035,004 | A | * | 3/1936 | Van Ness | 222/81 |
| 2,771,218 | A | * | 11/1956 | Henderson | 222/83 |
| 3,109,562 | A | * | 11/1963 | Ferris | 222/81 |
| 4,411,661 | A | * | 10/1983 | Kersten | 604/411 |
| 4,790,453 | A | * | 12/1988 | Fontana et al. | 222/83 |

FOREIGN PATENT DOCUMENTS

| | | | | |
|---|---|---|---|---|
| JP | 06144458 | A | * 5/1994 | B65D/51/22 |

* cited by examiner

*Primary Examiner*—Lee Young
*Assistant Examiner*—James Smalley

(57) ABSTRACT

The invention provides a device for inhibiting unused adhesive paste held within a commercially available dispensing squeeze tube from becoming unwanted hardened solids trapped within the mouth and nozzle of the squeeze tube. The invention provides a knurled knob or knurled cap griping means for pushing-in, pulling-out, and twisting an elongated spike into the mouth of the squeeze tube so that the spike can either minimize the amount of unwanted hardening of the any unused adhesive in the squeeze tube or to penetrate the resulting unwanted hardened solids at or near the mouth of the squeeze tube so as to create a fluid exit route for any remaining unused paste so that the contents are efficiently stored and used. The knurled knob or knurled cap also provides a safe means of preventing the user from being exposed to any unwanted unused adhesive onto the user's fingers and hands.

18 Claims, 3 Drawing Sheets

CONTAINER CLOSURE

BACKGROUND OF THE INVENTION

1. Field of Invention

The invention relates to caps to collapsible tubular dispensors, and in particular to caps to silicon squeeze tubes, in particular to caps that are able to inhibit the hardening of silicon paste within these tubes and are able to penetrate through any hardened silicon in these tubes to application of any unhardened silicon from these tubes.

2. Description of Prior Art

Collapsible squeeze tubes have become extremely popular containers and can be found in nearly all of the households throughout the world. Among the most common products stored in these types of squeeze tubes are toothpaste, various other beauty aids and many household adhesives. These collapsible squeeze tubes all share the common advantages of providing a small and convenient amount of the product stored in a convenient dispensing apparatus, as well as, they all share the same common problem of the product stored within the squeeze tubes drying up if the cap is not securely returned to the mouth of the squeeze tube. Access of the non-dried useable portions of the unused products remaining in these squeeze tubes when these tubes get blocked by the dried product itself is usually achieved by squeezing hard on the tube itself to push the blocked material away or by gouging into the blocked material to either physically removing the hardened block or to poking a hole through the hardened block to provide a fluid exit pathway for the unused paste product. This problem is further aggravated with pastes that contain highly volatile solvents that evaporate readily when the squeeze tube is left open. In particular silicon paste adhesive stored in these convenient squeeze tubes often suffers in wasting the stored silicon within the squeeze tubes because the silicon paste adhesive rapidly hardens at the mouth and deep within the silicon squeeze tube. As a result of this relatively rapid hardening of silicon paste into a hardened silicon solids within these squeeze tubes, the household user ends up using these silicon adhesive squeeze tubes for only a single occasion because the resulting hardened silicon solids block the mouth of the squeeze tubes and thus wasting the remaining unused silicon held deep within the silicon squeeze tube.

The common practice of inserting a nail into the mouth of these silicon squeeze tubes has been a successful tactic in preventing clogs in the silicon tubes but the practice of using nails as sealing devices for these tubes has a number of undesirable features. In particular, one of the major disadvantages in using nails to seal silicon squeeze tubes is that nails lack a substantial head for griping and thus the user is prone to being exposing to the silicon adhesive paste oozing over the nail head and contacting the user's epidermis. In addition because nails have a narrow head, the user is likely to have an insufficient grip in manipulating the nail while the nail spear is penetrated within the silicon adhesive paste.

The nozzle perforated cap for collapsible tubes as disclosed by Ferris in U.S. Pat. No. 3,109,562 provides a cap or a cover having a sharp point or spur mounted in the interior surface of the cap wherein the tip of the discharge nozzle of the collapsible tube may be both perforated a safety seal at the mouth of the tube as well as providing a sealing position. However, the Ferris disclosure would not be able to adequately break the blockage brought about by the anticipated hardened silicon solids experienced by incorrectly securing the cap or inadvertantly leaving the cap off.

The container opener disclosed by Ogawa and Hirono in U.S. Pat. No. 4,146,152 provides a sharp member capable of making a relatively small pinhole in the closed end portion of a nozzle of a tube containing low viscosity liquid adhesives, such as ∀-cyanoacrylate. By providing a pin within the cap, Ogawa and Hirono were able to succeed in making a safer opener for these low viscosity toxic adhesives, whereby preventing unwanted spillage onto the person opening these containers. However, the Ogawa and Hirono disclosure would be totally inadequate for use in high viscosity adhesives, such as silica paste adhesives, because an opening the size of a pinhole would not only likely to immediately clog but it would certainly be unable to deliver adequate amounts of silicon through the pinhole. Furthermore, the Ogawa and Hirono disclosure is silent with regards to the problem of clogs created by hardened silicon solids at and deep beyond the mouth of a squeeze tube nor do they address the problem of unclogging a hardened solid substantially beyond the mouth of the tube and deeper within the squeeze tube.

The cap disclosed by Miller in U.S. Pat. No. 1,909,209, as well as, the cap disclosed by Court in U.S. Pat. No. 2,365,524, and the cap disclosed by Oka in U.S. Pat. No. 4,678,098 all provide a disclosure of a relatively short axial conical projection, lacking any elongated stem, placed within the inside of a cap that serves not only as a puncturing device for the seal but also as a removable closure device for the puncture which it makes. However, the disclosures of Miller, Court and Oka are silent with regards to unclogging blocked openings once they do form and are silent with regards to unclogging passages and are likely to fail unclogging hardened blockages at the mouth of a dispensing tube. Furthermore, the Miller, Court and Oka disclosures are totally silent with regards on unclogging relatively deep blockages beyond the mere surface of the mouth of the tube.

The closure-penetrating support for a bottle disclosed by Sullivan in U.S. Pat. No. D-280,692 discloses only the ornamental design of a closure penetrating support for a water bottle and would be inadequate for preventing a clog from occurring because of the cap has substantial holes built within it and thus would be inadequate as a sealing device.

SUMMARY OF THE INVENTION

In view of the foregoing disadvantages inherent in the known types of cap appartus now present in the prior art, the present invention provides a puncture and seal cap apparatus wherein the same includes a knurled knob member secured to an associated elongated spike structure to effect puncturing any seal placed on the mouth of the silicon squeeze tube, as well as, seal silicon squeeze tubes so that they do not be clogged by either preventing evaporation of the solvent in the silicon paste adhesive or by supplying a device to capable of gouging out any hardened silicon solids at or below the mouth of these silicon squeeze tubes.

To attain this, one preferred embodiment of the present invention provides a container closure apparatus to be used in combination with a commercially available silicon dispensing squeeze tube for inhibiting any unused silicon adhesive paste held within the squeeze tube from becoming unwanted hardened silicon solids trapped within the mouth or nozzle of the squeeze tube and for penetrating the unwanted hardened silicon solids trapped within the squeeze tube to allow a fluid exit pathway for the unused silicon adhesive paste held within the squeeze tube while preventing unwanted exposure of any of the unused silicon adhesive paste to a user's epidermis, thereby creating a safe and effective device for saving the unused silicon adhesive paste, the container closure apparatus comprising: a knurled cap, having a generally flat top and a generally flat bottom, an inner wall, and an outer wall, the knurled cap outer wall comprising three generally octagonally shaped polygons horizontally stacked and fused together, wherein each of the generally octagonally shaped polygons having alternating substantially flattened edges followed by generally rounded edges, wherein the three generally octagonally shaped polygons of the knurled cap outer wall are horizontally stacked in a manner where the vertexes of each of the polygon shifted approximately twenty two and one-half degrees, relative to the alignment of the vertexes of the adjacent horizontally stacked polygon, wherein the knurled cap is capable of providing the user a sufficient griping means to push-in, to pull-out and to twist-in a portion of the container closure apparatus into the unused silicon adhesive paste held in the squeeze tube without exposing any of the unused silicon adhesive paste to the user's epidermis, wherein the knurled cap is capable of providing the user the sufficient griping means to push-in, to pull-out and to twist in a portion of the unwanted hardened silicon solids within the squeeze tube, and the knurled cap inner wall comprising a lower portion of the inner wall being substantially cylindrical for providing a tight fit over a the squeeze tube mouth and a portion of the squeeze tube nozzle, wherein the bottom end of the knurled cap is capable of being placed substantially flush with the squeeze tube mouth to aid in minimizing the unwanted hardened silicon solids from forming within the squeeze tube whereby inhibiting the hardening of the unused silicon adhesive paste by reducing the evaporation rate and subsequent escape of the supporting solvent in the commercial silicon adhesive paste from the squeeze tube; wherein the inside wall is threaded to fit the threaded portion of the threads of the squeeze tube nozzle, whereby twisting the knurled cap over the squeeze tube mouth and nozzle provides the tight fit whereby inhibiting the hardening of the unused silicon adhesive paste by reducing the evaporation rate and subsequent escape of the supporting solvent in the commercial silicon adhesive paste from the squeeze tube; and an elongated spike having a generally blunt end, a generally conical shaped pointed end and a generally cylindrical collar, the elongated spike is coaxially attached at the blunt end of the spike at approximately the center of the knurled cap bottom, whereby the vertical axis of the knurled cap is substantially in line with the vertical axis of the spike, wherein the generally conical shaped pointed end and the generally cylindrical collar of the spike are capable of being pushed-in, pulled-out and twisted-in through the squeeze tube mouth and nozzle into the unused silicon adhesive paste in the squeeze tube in order to minimize the unwanted harden silicon solids from forming within the squeeze tube by occupying a substantial portion of the volume in the squeeze tube mouth and nozzle whereby inhibiting the hardening of the unused silicon adhesive paste by reducing the evaporation rate and subsequent escape of the supporting solvent in the unused silicon adhesive paste from the squeeze tube, and wherein the generally conical shaped pointed end and the generally cylindrical collar of the spike are capable being pushed-in, pulled-out and twisted-in through the squeeze tube mouth and nozzle and into the unwanted hardened silicon solids trapped within the squeeze tube in order to create the fluid exit pathway through the unwanted hardened silicon solids within the squeeze tube so that the unused silicon adhesive paste in the squeeze tube may be dispensed through the fluid exit pathway and out through the mouth of the squeeze tube to any desired location chosen by the user.

To attain this, another preferred embodiment of the present invention provides a container closure apparatus to be used in combination with a commercially available silicon dispensing squeeze tube for inhibiting any unused silicon adhesive paste held within the squeeze tube from becoming unwanted hardened silicon solids trapped within the squeeze tube and for penetrating the unwanted hardened silicon solids trapped within the squeeze tube to allow a fluid exit pathway for the unused silicon adhesive paste held within the squeeze tube while preventing exposure of any of the unused silicon adhesive paste to a user's epidermis, thereby creating a safe and effective device for saving the unused silicon adhesive paste, the container closure apparatus comprising: a knurled knob, having a generally flat top and a generally flat bottom, comprising three generally octagonally shaped plates horizontally stacked and fused together, wherein each of the generally octagonally shaped plates having alternating substantially flattened edges followed by generally rounded edges, wherein the knurled knob is capable of allowing a user a sufficient griping means to push-in, to pull-out and to twist-in a portion of the container closure apparatus into the unused silicon adhesive paste held in the squeeze tube without exposing any of the unused silicon adhesive paste to the user's epidermis, wherein the knurled knob is capable of allowing the user the sufficient griping means to push-in, to pull-out and to twist in a portion of the unwanted hardened silicon solids within the squeeze tube, and wherein the bottom end of the knurled knob is capable of being placed substantially flush with the mouth of the squeeze tube to aid in minimizing the unwanted hardened silicon solids within the squeeze tube by inhibiting evaporation of the supporting solvent in the unused silicon adhesive paste within the squeeze tube; and an elongated spike having a generally blunt end, a generally conical shaped pointed end and a generally cylindrical collar, coaxially attached at the blunt end of the spike to approximately the center of the knurled knob bottom, whereby the vertical axis of the knurled knob is substantially in line with the vertical axis of the spike, wherein the generally conical shaped pointed end and the generally cylindrical collar of the spike are capable of being pushed-in, pulled-out and twisted-in through the mouth of the squeeze tube into the unused silicon adhesive paste in the squeeze tube in order to minimize the unwanted harden silicon solids from forming within the squeeze tube by occupying a substantial portion of the volume in the squeeze tube mouth and nozzle whereby inhibiting the hardening of the unused silicon adhesive paste by reducing the evaporation and subsequent escape of the supporting solvent in the unused silicon adhesive paste, and wherein the generally conical shaped pointed end and the generally cylindrical collar of the spike are capable being pushed-in, pulled-out and twisted-in through the mouth of the squeeze tube and into the unwanted hardened silicon solids trapped within the squeeze tube in order to create the fluid exit pathway through the unwanted hardened silicon solids within the squeeze tube so that the unused silicon adhesive paste in the squeeze tube may be dispensed through the fluid exit pathway and out through the mouth of the squeeze tube to any desired location chosen by the user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, not is it intended to be limiting as to the scope of the invention in any way.

Accordingly, one of the advantages of this present invention are that it provides a squeeze tube containing silicon adhesive paste a cap with a means of preventing unwanted hardened silicon solids trapped within a squeeze tube which subsequently prevents access of using the remaining silicon paste adhesive in the squeeze tube and thus saving silicon.

Also a further advantage of this present invention is provides a means of penetrating the unwanted hardened silicon at or near the mouth of the squeeze tube so that a fluid exit pathway can be created which would allow a significant portion of the remaining silicon paste adhesive to be expelled through the mouth of the squeeze tube.

Still a further advantage of this present invention is that it provides a means for griping a spike into the unused silicon adhesive paste held within a squeeze tube without exposing the user to the direct contact of the unused silicon adhesive paste onto the users epidermis.

Yet an even further advantage of this present invention is that it provides a means for manipulating the spike portion of the cap by allowing a user to easily grip the knurled knob so that the spike may be conveniently controlled when prying out any unwanted silicon solids trapped near the squeeze tube mouth or stabbing a hole through the unwanted silicon solids so that the remaining silicon paste can be accessed without directly contacting the unused silicon adhesive paste onto the users epidermis.

BRIEF DESCRIPTION OF THE DRAWINGS

For a more complete understanding of the present invention and for further objects and advantages thereof, reference may now be had to the following description taken in conjunction with the accompanying drawing in which.

DETAILED DISCLOSURE OF PREFERRED EMBODIMENTS

Although specific features of the invention are shown in some drawings and not others, this is for convenience only as each feature may be combined with any or all of the other features in accordance with the invention.

While preferred illustrative embodiments of the invention are described above, it will be apparent to those skilled in the art that various changes and modifications may be made without departing from the invention. The appended claims are intended to cover all changes within the spirit of the invention.

Figure 1:
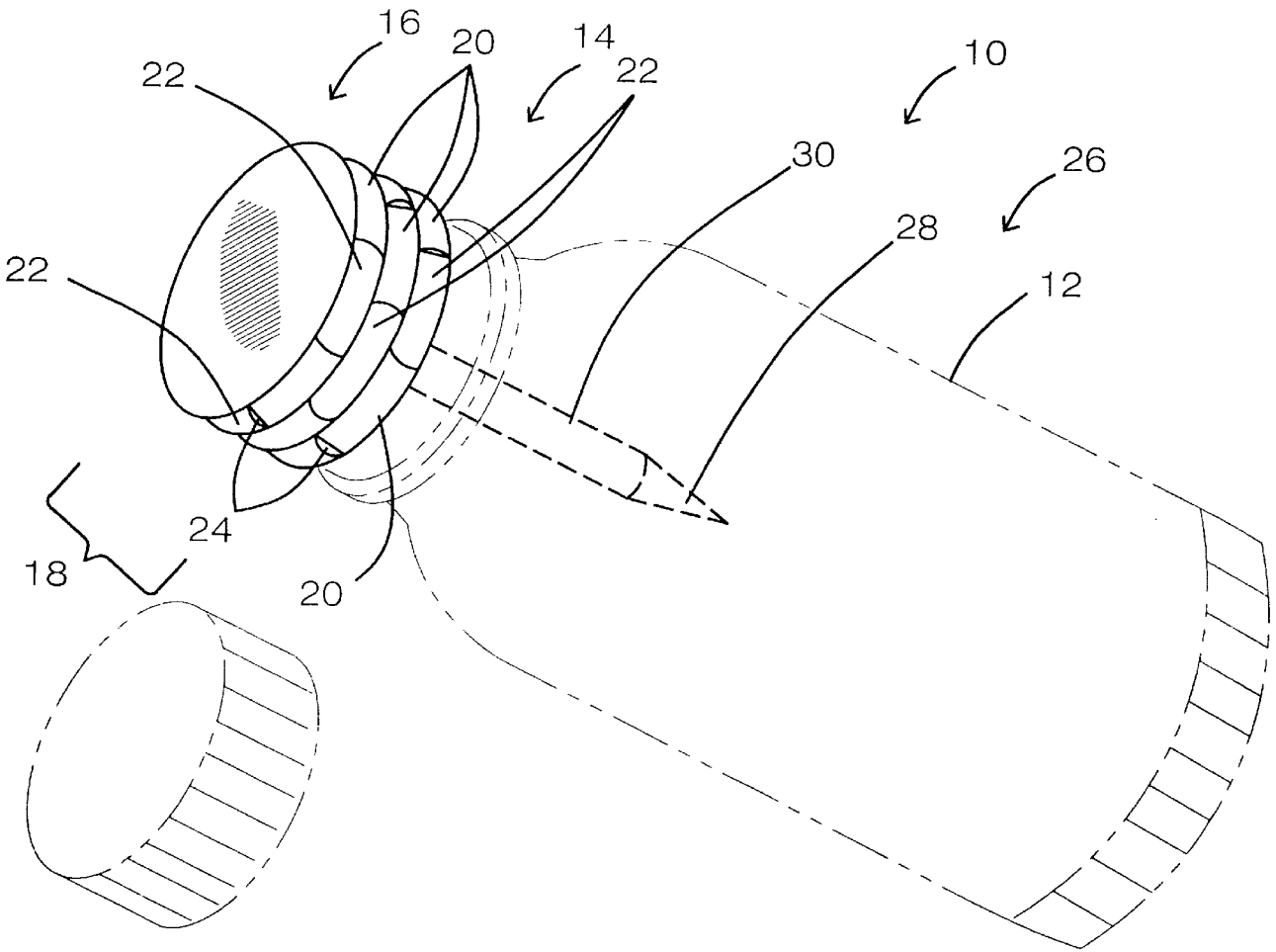
FIG. 1 is perspective view of a container closure apparatus inserted in a silicon squeeze tube according to the present invention.
Figure 2:
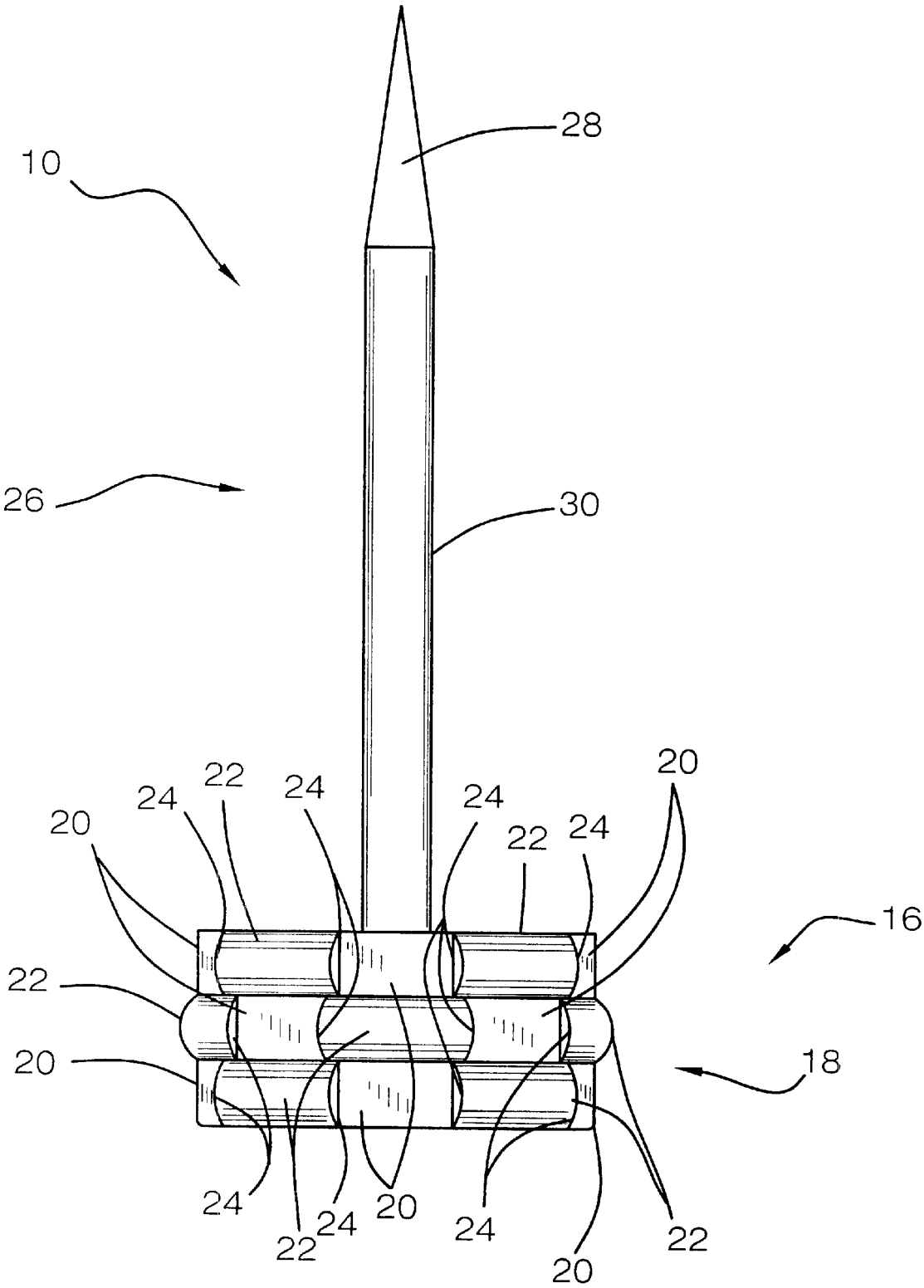
FIG. 2 is a lateral view of a container closure apparatus.

Referring now to the drawings, and particularly to FIG. 1 and FIG. 2, a preferred embodiment of the container closure apparatus 10 of the present invention is shown and generally designated by the reference numeral 10. This preferred embodiment of the container closure apparatus 10 to be used in combination with a commercially available silicon dispensing squeeze tube 12 for inhibiting any unused silicon adhesive paste held within the squeeze tube 12 from becoming unwanted hardened silicon solids trapped within the mouth (not shown) or nozzle 14 of the squeeze tube 12 and for penetrating the unwanted hardened silicon solids trapped (not shown) within the squeeze tube 12 to allow a fluid exit pathway for the unused silicon adhesive paste held within the squeeze tube 12 while preventing unwanted exposure of any of the unused silicon adhesive paste to a user's epidermis, thereby creating a safe and effective device for saving the unused silicon adhesive paste, the container closure apparatus comprising: a knurled cap 16, having a generally flat top and a generally flat bottom, an inner wall, and an outer wall, the outer wall of the knurled cap 16 is composed of three generally octagonally shaped polygons 18 horizontally stacked and fused together, wherein each of the generally octagonally shaped polygons 18 having alternating substantially flattened edges 20 followed by generally rounded edges 22, wherein the three generally octagonally shaped polygons 18 form the outer wall of the knurled cap 16 by being horizontally stacked in a manner where the vertexes 24 of each of the octagonally shaped polygon 18 shifted approximately twenty two and one-half degrees, relative to the alignment of the vertexes 24 of the adjacent horizontally stacked octagonally shaped polygon 18, wherein the knurled cap 16 is capable of. providing the user a sufficient griping means to push-in, to pull-out and to twist-in a portion of the container closure apparatus 10 into the unused silicon adhesive paste held in the squeeze tube 12 while minimizing any expose of the unused silicon adhesive paste to the user's epidermis, wherein the knurled cap 16 is capable of providing the user the sufficient griping means to push-in, to pull-out and to twist in a portion of the unwanted hardened silicon solids within the squeeze tube 12, and the knurled cap inner wall (not illustrated) comprising a lower portion of the inner wall being substantially cylindrical for providing a tight fit over the mouth (not shown) and a portion of the nozzle 14 of the squeeze tube 12, wherein the bottom end (not shown) of the knurled cap 16 is capable of being placed substantially flush with the mouth of the squeeze tube 12 to aid in minimizing the unwanted hardened silicon solids from forming within the squeeze tube 12 whereby inhibiting the hardening of the unused silicon adhesive paste by reducing the evaporation rate and subsequent escape of the supporting solvent in the commercial silicon adhesive paste from the squeeze tube 12; wherein the inside wall is threaded to fit the threaded portion (not shown) of the threads of the squeeze tube nozzle 14, whereby twisting the knurled cap over the mouth (not shown) and nozzle 14 of the squeeze tube 12 provides the tight fit whereby inhibiting the hardening of the unused silicon adhesive paste by reducing the evaporation rate and subsequent escape of the supporting solvent in the commercial silicon adhesive paste from the squeeze tube 12; and an elongated spike 26 having a generally blunt end, a generally conical shaped pointed end 28 and a generally cylindrical collar 30, wherein the elongated spike 26 is coaxially attached at the blunt end (not shown) of the spike 26 at approximately the center of the bottom (not shown) of the knurled cap 16, whereby the vertical axis of the knurled cap 16 is substantially in line with the vertical axis of the spike 26, wherein the generally conical shaped pointed end 28 and the generally cylindrical collar 30 of the spike 26 are capable of being pushed-in, pulled-out and twisted-in through the mouth (not shown) and through the nozzle 14 of the squeeze tube 12 into the unused silicon adhesive paste in the squeeze tube 12 in order to minimize the unwanted harden silicon solids from forming within the squeeze tube 12 by occupying a substantial portion of the volume in the mouth (not shown) and nozzle 14 of the squeeze tube 12 whereby inhibiting the hardening of the unused silicon adhesive paste by reducing the evaporation rate and subsequent escape of the supporting solvent in the unused silicon adhesive paste from the squeeze tube 12, and wherein the generally conical shaped pointed end 28 and the generally cylindrical collar 30 of the spike 26 are capable being pushed-in, pulled-out and twisted-in through the mouth (not shown) and the nozzle 14 of the squeeze tube 12 and into the unwanted hardened silicon solids trapped within the squeeze tube 12 in order to create the fluid exit pathway through the unwanted hardened silicon solids within the squeeze tube 12 so that the unused silicon adhesive paste in the squeeze tube 12 may be dispensed through the fluid exit pathway and out through the mouth (not shown) of the squeeze tube 12 to any desired location chosen by the user.

Figure 3:
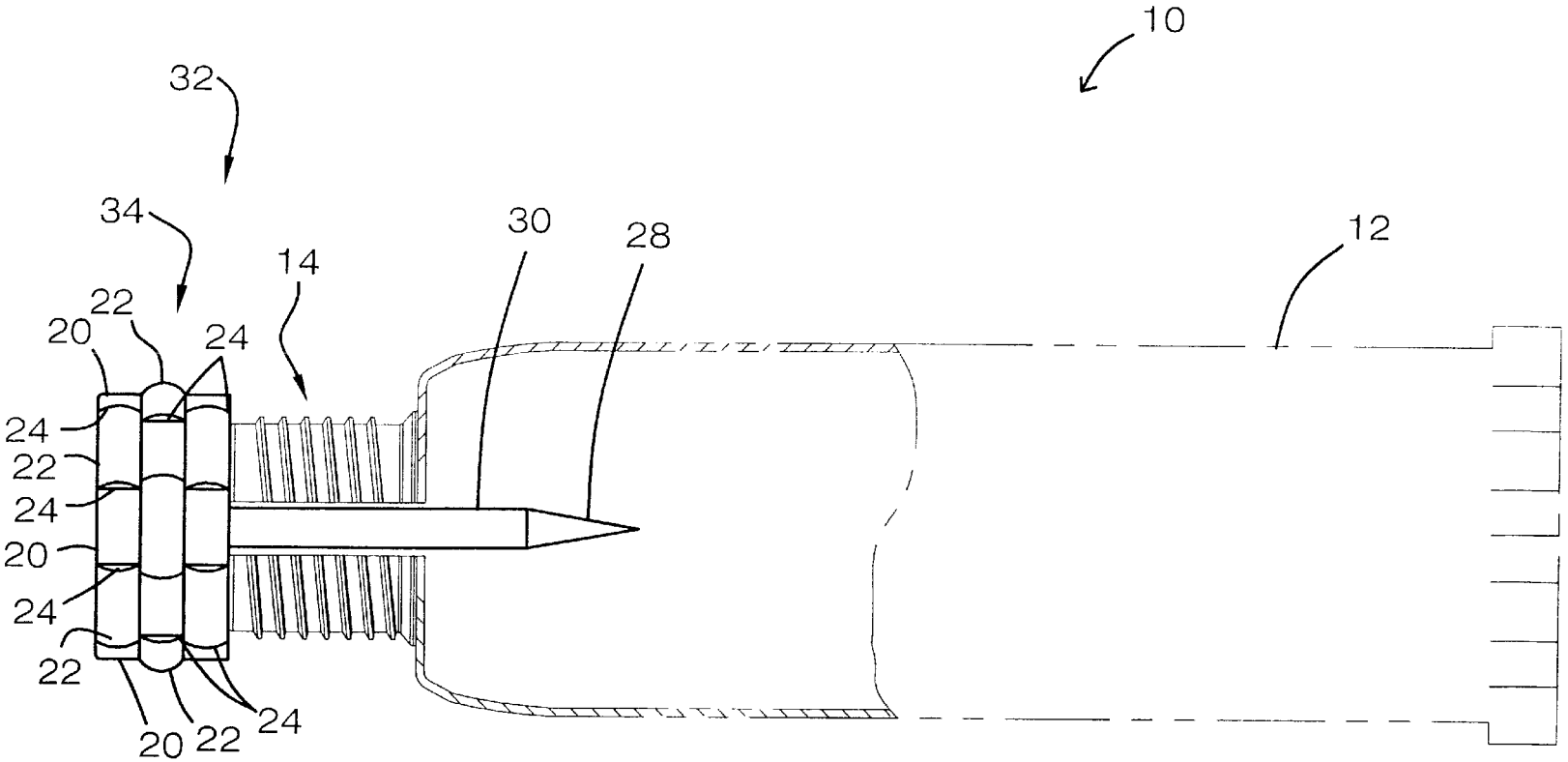
FIG. 3 is an perspective view of a container closure apparatus depicting in a silicon squeeze tube.

Referring now to the drawings, and particularly to FIG. 3, shows another preferred embodiment of the container closure apparatus 10 to be used in combination with a commercially available silicon dispensing squeeze tube 12 for inhibiting any unused silicon adhesive paste held within the squeeze tube 12 from becoming unwanted hardened silicon solids trapped (not shown) within the squeeze tube 12 and for penetrating the unwanted hardened silicon solids trapped (not shown) within the squeeze tube 12 to allow a fluid exit pathway for the unused silicon adhesive paste held within the squeeze tube 12 while preventing exposure of any of the unused silicon adhesive paste to a user's epidermis, thereby creating a safe and effective device for saving the unused silicon adhesive paste, the container closure apparatus 10 comprising: a knurled knob 32, having a generally flat top and a generally flat bottom, comprising three generally octagonally shaped plates 34 horizontally stacked and fused together, wherein each of the generally octagonally shaped plates 34 having alternating substantially flattened edges 20 followed by generally rounded edges 22, wherein the knurled knob 32 is capable of allowing a user a sufficient griping means to push-in, to pull-out and to twist-in a portion of the container closure apparatus 10 into the unused silicon adhesive paste held in the squeeze tube 12 without exposing any of the unused silicon adhesive paste to the user's epidermis, wherein the knurled knob 32 is capable of allowing the user the sufficient griping means to push-in, to pull-out and to twist in a portion of the unwanted hardened silicon solids within the squeeze tube 12, and wherein the bottom end of the knurled knob 32 is capable of being placed substantially flush with the mouth of the squeeze tube 12 to aid in minimizing the unwanted hardened silicon solids within the squeeze tube 12 by inhibiting evaporation of the supporting solvent in the unused silicon adhesive paste within the squeeze tube 12; and an elongated spike 26 having a generally blunt end (not shown), a generally conical shaped pointed end 28 and a generally cylindrical collar 30, coaxially attached at the blunt end of the spike 26 to approximately the center of the bottom (not shown) to the knurled knob 32, whereby the vertical axis of the knurled knob 32 is substantially in line with the vertical axis of the spike 26, wherein the generally conical shaped pointed end 28 and the generally cylindrical collar 30 of the spike 26 are capable of being pushed-in, pulled-out and twisted-in through the mouth of the squeeze tube 12 into the unused silicon adhesive paste in the squeeze tube 12 in order to minimize the unwanted harden silicon solids from forming within the squeeze tube 12 by occupying a substantial portion of the volume in the mouth (not shown) and the nozzle 14 of the the squeeze tube 12 whereby inhibiting the hardening of the unused silicon adhesive paste by reducing the evaporation and subsequent escape of the supporting solvent in the unused silicon adhesive paste, and wherein the generally conical shaped pointed end 28 and the generally cylindrical collar 30 of the spike 26 are capable of being pushed-in, pulled-out and twisted-in through the mouth (not shown) of the squeeze tube 12 and into the unwanted hardened silicon solids trapped within the squeeze tube 12 in order to create the fluid exit pathway through the unwanted hardened silicon solids within the squeeze tube 12 so that the unused silicon adhesive paste in the squeeze tube 12 may be dispensed through the fluid exit pathway and out through the mouth (not shown) of the squeeze tube 12 to any desired location chosen by the user.

While the invention has been described in detail with respect to several preferred embodiments thereof, it will be understood by those skilled in the art, after reading this specification, that various changes and modifications may be made without departing form the spirit of the invention and the scope of the appended claims.

I claim:

1. A container closure apparatus to be used in combination with a commercially available dispensing squeeze tube for inhibiting any unused adhesive paste held within said squeeze tube from becoming unwanted hardened solids trapped within the mouth or nozzle of said squeeze tube arid for penetrating said unwanted hardened solids trapped within said squeeze tube to allow a fluid exit pathway for said unused adhesive paste held within said squeeze tube while preventing unwanted exposure of any of said unused adhesive paste to a user's epidermis, thereby creating a safe and effective device for saving said unused adhesive paste, said container closure apparatus comprising:

a knurled cap, having a generally flat top and a generally flat bottom, an inner wall, and an outer wall, said knurled cap outer wall comprising three generally octagonally shaped polygons horizontally stacked and fused together, wherein each of said generally octagonally shaped polygons having alternating substantially flattened edges followed by generally rounded edges, wherein said three generally octagonally shaped polygons of said knurled cap outer wall are horizontally stacked in a manner where the vertexes of each of said polygon shifted approximately twenty two and one-half degrees, relative to the alignment of the vertexes of the adjacent horizontally stacked polygon, wherein said knurled cap is capable of providing said user a sufficient griping means to push-in, to pull-out and to twist-in a portion of said container closure apparatus into said unused adhesive paste held in said squeeze tube while minimizing any expose of said unused adhesive paste to said user's epidermis, wherein said knurled cap is capable of providing said user said sufficient griping means to push-in, to pull-out and to twist in a portion of said unwanted hardened solids within said squeeze tube, and said knurled cap inner wall comprising a lower portion of said inner wall being substantially cylindrical for providing a tight fit over said squeeze tube mouth and a portion of said squeeze tube nozzle, wherein said bottom end of said knurled cap is capable of being placed substantially flush with said squeeze tube mouth to aid in minimizing said unwanted hardened solids from forming within said squeeze tube whereby inhibiting the hardening of said unused adhesive paste by reducing the evaporation rate and subsequent escape of the supporting solvent in said commercial adhesive paste from said squeeze tube;

wherein the inside wall is threaded to fit the threaded portion of the threads of said squeeze tube nozzle, whereby twisting said knurled cap over said squeeze tube mouth and nozzle provides said tight fit whereby inhibiting the hardening of said unused adhesive paste by reducing the evaporation rate and subsequent escape of the supporting solvent in said commercial adhesive paste from said squeeze tube; and an elongated spike having a generally blunt end, a generally conical shaped pointed end and a generally cylindrical collar, said elongated spike is coaxially attached at said blunt end of said spike at approximately the center of said knurled cap bottom, whereby the vertical axis of the knurled cap is substantially in line with the vertical axis of the spike, wherein said generally conical shaped pointed end and said generally cylindrical collar of said spike are capable of being pushed-in, pulled-out and twisted-in through said squeeze tube mouth and nozzle into said unused adhesive paste in said squeeze tube in order to minimize said unwanted harden solids from forming within said squeeze tube by occupying a substantial portion of the volume in said squeeze tube mouth and nozzle whereby inhibiting the hardening of said unused adhesive paste by reducing the evaporation rate and subsequent escape of the supporting solvent in said unused adhesive paste from said squeeze tube, and wherein said generally conical shaped pointed end and said generally cylindrical collar of said spike are capable being pushed-in, pulled-out and twisted-in through said squeeze tube mouth and nozzle and into said unwanted hardened solids trapped within said squeeze tube in order to create said fluid exit pathway through said unwanted hardened solids within said squeeze tube so that said unused adhesive paste in said squeeze tube may be dispensed through said fluid exit pathway and out through said mouth of said squeeze tube to any desired location chosen by the user.

2. The apparatus of claim 1 wherein said adhesive is a silicon.

3. A container closure apparatus to be used in combination with a commercially available dispensing squeeze tube for inhibiting any unused adhesive paste held within said squeeze tube from becoming unwanted hardened solids trapped within the mouth or nozzle of said squeeze tube and for penetrating said unwanted hardened solids trapped within said squeeze tube to allow a fluid exit pathway for said unused adhesive paste held within said squeeze tube while preventing unwanted exposure of any of said unused adhesive paste to a user's epidermis, thereby creating a safe and effective device for saving said unused adhesive paste, said container closure apparatus comprising:

a knurled cap, having a generally flat top and a generally flat bottom, an inner wall, and an outer wall, said knurled cap outer wall comprising three generally octagonally shaped polygons horizontally stacked and fused together, wherein each of said generally octagonally shaped polygons having alternating substantially flattened edges followed by generally rounded edges, wherein said knurled cap is capable of providing said user a sufficient griping means to push-in, to pull-out and to twist-in a portion of said container closure apparatus into said unused adhesive paste held in said squeeze tube without exposing any of said unused adhesive paste to said user's epidermis, wherein said knurled cap is capable of providing said user sufficient griping means to push-in, to pull-out and to twist in a portion of said unwanted hardened solids within said squeeze tube, and said knurled cap inner wall comprising a lower portion of said inner wall being substantially cylindrical for providing a tight fit over a said squeeze tube mouth and a portion of said squeeze tube nozzle, wherein said bottom end of said knurled cap is capable of being placed substantially flush with said squeeze tube mouth to aid in minimizing said unwanted hardened solids from forming within said squeeze tube whereby inhibiting the hardening of said unused adhesive paste by reducing the evaporation rate and subsequent escape of the supporting solvent in said commercial adhesive paste from said squeeze tube; and an elongated spike having a generally blunt end, a generally conical shaped pointed end and a generally cylindrical collar, said elongated spike is coaxially attached at said blunt end of said spike at approximately the center of said knurled cap bottom, whereby the vertical axis of the knurled cap is substantially in line with the vertical axis of the spike, wherein said generally conical shaped pointed end and said generally cylindrical collar of said spike are capable of being pushed-in, pulled-out and twisted-in through said squeeze tube mouth and nozzle into said unused adhesive paste in said squeeze tube in order to minimize said unwanted hardened solids from forming within said squeeze tube by occupying a substantial portion of the volume in said squeeze tube mouth and nozzle whereby inhibiting the hardening of said unused adhesive paste by reducing the evaporation rate and subsequent escape of the supporting solvent in said unused adhesive paste from said squeeze tube, and wherein said generally conical shaped pointed end and said generally cylindrical collar of said spike are capable being pushed-in, pulled-out and twisted-in through said squeeze tube mouth and nozzle and into said unwanted hardened solids trapped within said squeeze tube in order to create said fluid exit pathway through said unwanted hardened solids within said squeeze tube so that said unused adhesive paste in said squeeze tube may be dispensed through said fluid exit pathway and out through said mouth of said squeeze tube to any desired location chosen by the user.

4. The container closure apparatus as described in claim 3, wherein said knurled cap outer wall is composed of said three generally octagonally shaped polygons are horizontally stacked in a manner where the vertexes of each of said polygon shifted approximately twenty two and one-half degrees, relative to the alignment of the vertexes of the adjacent horizontally stacked polygon.

5. The container closure apparatus as described in claim 3, wherein said knurled cap outer wall is composed of said three generally octagonally shaped polygons are horizontally stacked by having the vertexes of each of said polygon shifted approximately aligned along a line relative to the alignment of the vertexes of the adjacent horizontally stacked polygon.

6. The container closure apparatus as described in claim 3, wherein the inside diameter of said substantially cylindrical inner wall of said knurled cap is approximately the same size of the diameter of said squeeze tube nozzle, whereby placement of said knurled cap over said squeeze tube mouth and nozzle provides said tight fit.

7. The container closure apparatus as described in claim 3, wherein the inside wall is threaded to fit the threaded portion of the threads of said squeeze tube nozzle, whereby twisting said knurled cap over said squeeze tube mouth and nozzle provides said tight fit.

8. The container closure apparatus as described in claim 3, wherein the total length of said container closure apparatus is approximately one inch long.

9. The container closure apparatus as described in claim 3, wherein said container closure is composed of a single injection molded plastic body.

10. The container closure apparatus of claim 3 wherein said adhesive is a silicon.

11. A container closure apparatus to be used in combination with a commercially available dispensing squeeze tube for inhibiting any unused adhesive paste held within said squeeze tube from becoming unwanted hardened solids trapped within said squeeze tube and for penetrating said unwanted hardened solids trapped within said squeeze tube to allow a fluid exit pathway for said unused adhesive paste held within said squeeze tube while preventing exposure of any of said unused adhesive paste to a user's epidermis, thereby creating a safe and effective device for saving said unused adhesive paste, said container closure apparatus comprising:

a knurled knob, having a generally flat top and a generally flat bottom, comprising three generally octagonally shaped plates horizontally stacked and fused together, wherein each of said generally octagonally shaped plates having alternating substantially flattened edges followed by generally rounded edges, wherein said knurled knob is capable of allowing a user a sufficient griping means to push-in, to pull-out and to twist-in a portion of said container closure apparatus into said unused adhesive paste held in said squeeze tube without exposing any of said unused adhesive paste to said user's epidermis, wherein said knurled knob is capable of allowing said user sufficient griping means to push-in, to pull-out and to twist in a portion of said unwanted hardened solids within said squeeze tube, and wherein said bottom end of said knurled knob is capable of being placed substantially flush with the mouth of said squeeze tube to aid in minimizing said unwanted hardened solids within said squeeze tube by inhibiting evaporation of the supporting solvent in said unused adhesive paste within said squeeze tube; and an elongated spike having a generally blunt end, a generally conical shaped pointed end and a generally cylindrical collar, coaxially attached at the blunt end of said spike to approximately the center of said knurled knob bottom, whereby the vertical axis of the knurled knob is substantially in line with the vertical axis of the spike, wherein said generally conical shaped pointed end and said generally cylindrical collar of said spike are capable of being pushed-in, pulled-out and twisted-in through said mouth of said squeeze tube into said unused adhesive paste in said squeeze tube in order to minimize said unwanted hardened solids from forming within said squeeze tube by occupying a substantial portion of the volume in said squeeze tube mouth and nozzle whereby inhibiting the hardening of said unused adhesive paste by reducing the evaporation and subsequent escape of the supporting solvent in said unused adhesive paste, and wherein said generally conical shaped pointed end and said generally cylindrical collar of said spike are capable being pushed-in, pulled-out and twisted-in through said mouth of said squeeze tube and into said unwanted hardened solids trapped within said squeeze tube in order to create said fluid exit pathway through said unwanted hardened solids within said squeeze tube so that said unused adhesive paste in said squeeze tube may be dispensed through said fluid exit pathway and out through said mouth of said squeeze tube to any desired location chosen by the user.

12. The container closure apparatus as described in claim 11, wherein said three generally octagonally shaped plates are horizontally stacked by having the vertexes of each of said plates shifted approximately twenty two and one-half degrees, relative to the alignment of the vertexes of the adjacent horizontally stacked plate.

13. The container closure apparatus as described in claim 11, wherein said knurled cap outer wall is composed of said three generally octagonally shaped plates are horizontally stacked by having the vertexes of each of said plates shifted approximately aligned along a line relative to the alignment of the vertexes of the adjacent horizontally stacked plate.

14. The container closure apparatus as described in claim 11, wherein the total length of said container closure apparatus is approximately one inch long.

15. The container closure apparatus as described in claim 11, wherein said container closure is composed of a single injection molded plastic body.

16. The container closure apparatus as described in claim 15 wherein said container closure apparatus is made of polyethylene or polypropylene.

17. The container closure apparatus as described in claim 11 wherein said container closure apparatus is made of stainless steel or aluminum.

18. The container closure apparatus of claim 11 wherein said adhesive is a silicon.

* * * * *